United States Patent [19]

Cots Tana et al.

[11] Patent Number: 4,770,010

[45] Date of Patent: Sep. 13, 1988

[54] PROCEDURE FOR REMOVING THE LAYER OF HAIRY ELEMENTS FROM A COMPLETE ANIMAL SKIN

[76] Inventors: Juan Cots Tañá; Esteban Cots Tañá, both of Carre, Barcelona-puigcerda, km 69, 6 VIC, Barcelona, Spain

[21] Appl. No.: 939,437

[22] Filed: Dec. 4, 1986

[30] Foreign Application Priority Data

Dec. 17, 1985 [ES] Spain ..... 550.019

[51] Int. Cl.[4] ..... C14B 15/02

[52] U.S. Cl. ..... 69/22; 69/24; 69/28; 69/41

[58] Field of Search ..... 69/1, 22, 24, 26, 23, 69/28, 41, 44

[56] References Cited

U.S. PATENT DOCUMENTS

| | | | |
|---|---|---|---|
| 2,151,930 | 3/1939 | Messina et al. | 69/22 X |
| 2,559,329 | 7/1951 | Trod | 69/1 |
| 2,730,787 | 1/1956 | Bechtold | 69/1 X |
| 2,764,885 | 10/1956 | Eisen | 69/26 |

FOREIGN PATENT DOCUMENTS

| | | | |
|---|---|---|---|
| 2094600 | 2/1972 | France | 69/24 |

*Primary Examiner*—Wm. Carter Reynolds

*Attorney, Agent, or Firm*—Wenderoth, Lind & Ponack

[57] ABSTRACT

The present invention is drawn to a method of removing hair from an animal pelt in which liquified gas is applied to the fleshy side of the pelt to freeze the pelt to a temperature at which hair pores of the skin open. The application of the liquid gas to the pelt may be facilitated by placing the pelt on a conveyor having perforations, applying suction to the pelt through the perforations to secure the pelt to the conveyor, and applying the liquified gas to the pelt through the perforations. Furthermore, the application of the liquified gas to the pelt may be carried out in two phases. In the first phase, the pelt is frozen to a temperature between 0° and −20° Celsius. In the second phase, the pelt is frozen to a temperature between −20° and −220° Celsius. Finally, after the pelt has been frozen, the hair may be removed with an appropriate hair removing device such as a comb, blade or brush.

4 Claims, 3 Drawing Sheets

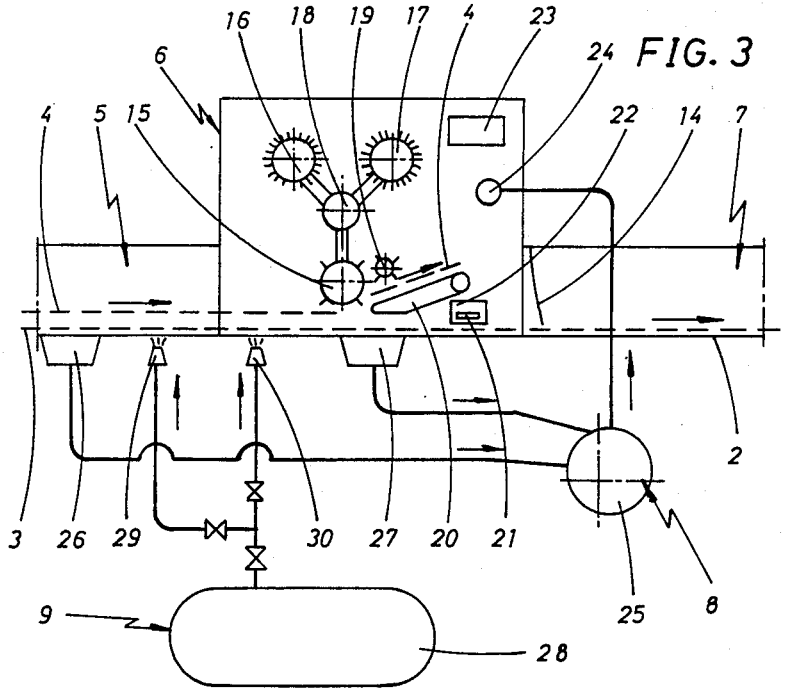
FIG. 3
FIG. 4
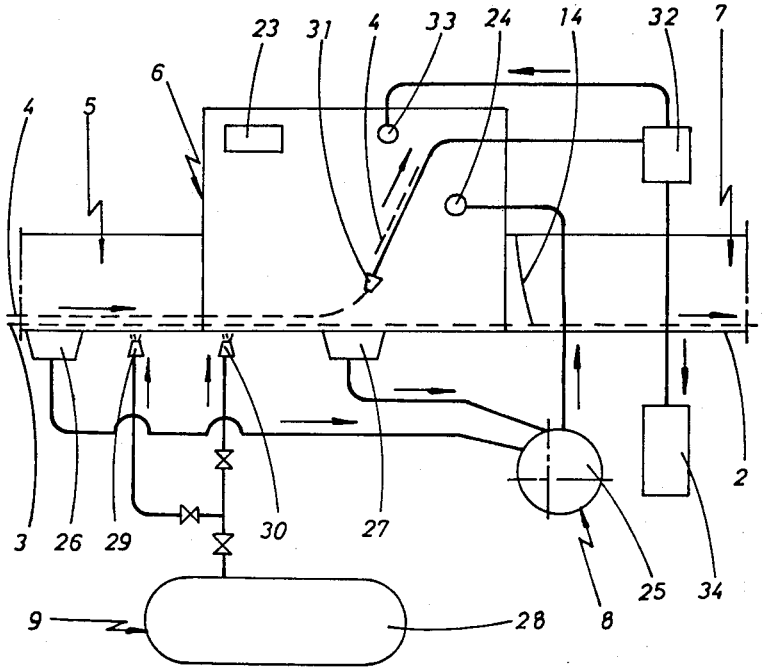

PROCEDURE FOR REMOVING THE LAYER OF HAIRY ELEMENTS FROM A COMPLETE ANIMAL SKIN

BACKGROUND OF THE INVENTION

The present invention relates to a process for removing hair and wool from entire animal pelt.

This method is a radical departure from methods currently used for removing wool or hair from animal pelts. By way of reference, two of the more conventional current methods of removing hair or wool from the pelt (dewoolling or peeling) are described below:

(a) Sodium sulphide and calcium hydroxide method.

The fleshy side of the skin is painted or impregnated with sodium sulphide either by hand or by an appropriate mechanical means. The sodium sulphide penetrates from the flesh to the root of the wool or hair and destroys it. A delay necessarily occurs between the time of application of the sodium sulphide and the time the union between the skin and the wool or hair is destroyed. Once the hair or wool has been removed the skin deteriorates rapidly and washing and neutralizing operations must be carried out as quickly as possible.

The wool or hair is effected in the same manner by the sodium sulphide and should be rinsed immediately to avoid deterioration and putrefaction. The washing process must be carried out particularly effectively to ensure that the residue of the sodium sulphide is diluted and neutralized as well as to rinse away the dirt in the wool or the hair.

It should be kept in mind that the most important side of the skin is the grain or natural pore surface from which the hair or wool is extracted and great care should be taken during all treatment processes.

The epidermis, which is a fine protective layer covering the grain of the skin, is seriously effected by chemicals present in the sodium sulphide bath. For this reason, great care must be taken in the preparation of the solution used to remove the wool or hair, as excessively concentrated solution may cause irreparable damage to the grain side of the skin. Such blemishes are known in the trade as "low grain" and may consist of stains, unnatural swelling or even rupture of the structure of the epidermis. It is clear that this process carries with it considerable disadvantages.

(b) Putrefaction method

The pelt is placed in a temperature and humidity-controlled room until a definite opening or enlargement of the wool or hair follicle is noted. At this stage, the hair or wool may be pulled away from the skin either manually or by using appropriate mechanical methods. This process is normally employed by wool traders and not by Tanners and consequently the skin receives deleterious treatment as it is allowed to reach a semi-putrid state due to the heat and the humidity. Skins which have been subjected to this process are generally of inferior quality. This process, however, does have the advantage that the wool or hair remains unaffected by chemicals unlike the previously described process.

SUMMARY OF THE INVENTION

It is an object therefore of this invention to at least overcome the abovementioned problems or at least provide the public with a useful choice.

Other objects of this invention become apparent from the following description.

According to one aspect of this invention there is provided a method of hair removal from an animal pelt including freezing a skin portion of said pelt to a temperature where pores open releasing the hair of the skin and removing hairs from the skin.

Other aspects of this invention which should be considered in all its novel aspects become apparent from the following description.

A summary of the preferred form of the invention will now be described with reference to the dewoolling of an animal pelt such as the pelt of a sheep. The procedure in accordance with the invention is characterised by the fact that the fresh animal pelt in its flexible state is positioned, flesh side on a movable apertured support. The pelt is subjected to suction from within the support acting through the apertures which secures the pelt onto the support. At least one application of a liquified gas is carried out against the flesh side of the pelt through the apertured surface to effect a preliminary freezing of between zero (0) degrees celsius and minus twenty (20) degrees celsius of the skin of the pelt. Thereafter, the pelt is subjected to one or more sprayings with the same or another liquified gas so as to cool the skin to a temperature of about minus twenty (20) degrees of about minus two hundred and twenty (220) degrees celsius and thereafter extraction of the wool is carried out by conventional pulling means. The dewoolled skin is warmed until a temperature at which it can be handled is reached.

When the skin of the pelt is particularly thick the freezing process occurs relatively slowly with a proportionately high consumption of liquified gas. Given that the object of the freezing process is for the freezing to occur at the root of the hair or wool as rapidly as possible, it is envisioned that the liquified gas may also be applied on the upper surface of the skin. A minimum of one further application of liquified gas to the upper side of the skin will accelerate freezing of the roots of the hair or wool, thereby increasing the efficiency of the extraction process.

Any such acceleration in the freezing process will ensure greater overall uniformity and will serve to lessen the risk of undesirable contractions in the leather. The skin will be more stable and will conform more easily to the perforated conveyor belt with the possibility that the necessity for a suction securing system may be avoided. The application of the liquified gas to the upper surface of the pelt may be carried out contemporaneously with its administration to the lower surface or, alternatively, these processes may be carried out separately if desired.

The present invention is also characterized by the type of liquified gases used for freezing the pelt which are as follows:

Nitrogen, Carbon-dioxide, liquid air, freon and argon. It should be noted, however, that liquid nitrogen is preferred for this process.

BRIEF DESCRIPTION OF THE DRAWINGS

FIG. 3 is a schematic diagram showing extraction equipment which consists of rotating cylinders.

FIG. 4 is similar to FIG. 3 except that the extraction equipment is supplemented by a pneumatic suction device.

DESCRIPTION OF THE PREFERRED EMBODIMENTS

Figure 1:
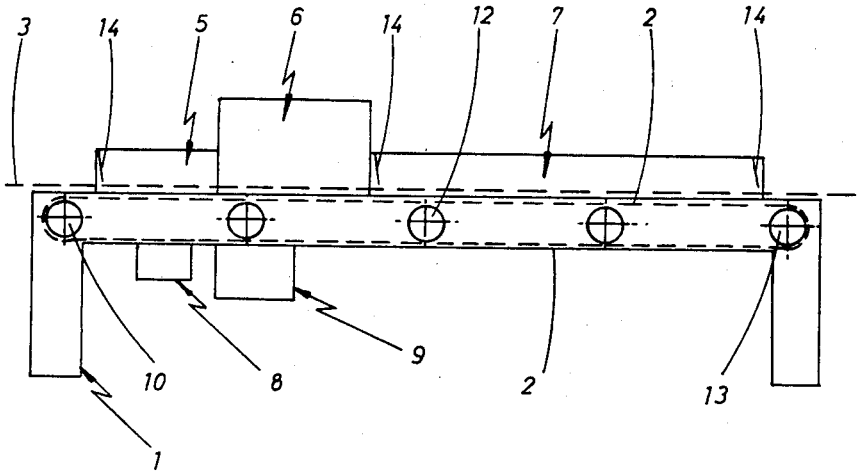
FIG. 1 is a side view of an apparatus for performing the processes of extracting wool or hair from complete animal pelts according to the present invention.

The process which is the subject of this invention may be carried out using a frame (1) equipped with a perforated conveyor belt (2) or a drum which secures and transport the animal skins (3) which are placed fleshy side down on the conveyor belt and then pass through a preparation tunnel (5), a hair or wool removal area (6) and a recovery tunnel (7). The pneumatic equipment (8) and liquified gas (preferably nitrogen) (9) injection equipment are housed in the lower part of the frame (1). The conveyor belt (2) is driven by a cylinder (10) which is in turn driven by a motor (11) and runs over freely rotating rollers (12) and a tension cylinder (13).

Figure 2:
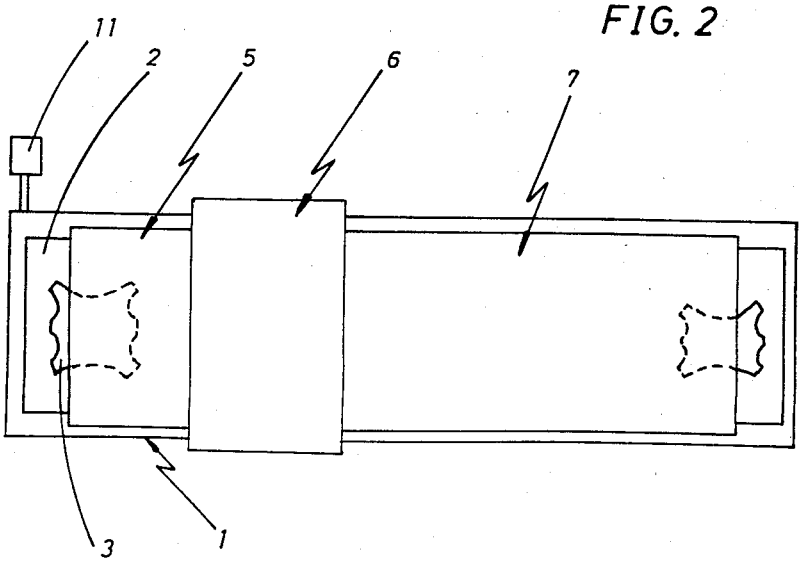
FIG. 2 is a plan view of the apparatus depicted in FIG. 1.

The tunnels (5) and (7) are equipped with isolation curtains (14) as shown in FIGS. 1 and 2.

The extraction area (6) as shown in FIG. 3 comprises a set of three revolving rollers (15, 16 and 17) mounted on a base rotatable on an axle (18) equipped with the desired medium (comb, blade and brush). The active roller is equipped with a wool or hair expulsion device (19). The equipment also comprises a belt (20) which picks up the wool or hair and carries it to a further belt (21) which in turn carries the wool or hair to a pipe (22). A cold air intake pipe (23) is also provided.

As shown in FIG. 3, an optional inlet (24) may be provided for recycled air which comes from the pneumatic equipment 8. The latter equipment consists of ventilator fan (25) and primary (26) and principal (27) suction ventilators.

The nitrogen spray equipment consists of a nitrogen tank (28) and associated piping feeding the primary (29) and principal (30) nozzles by means of appropriate valves.

Figure 5:
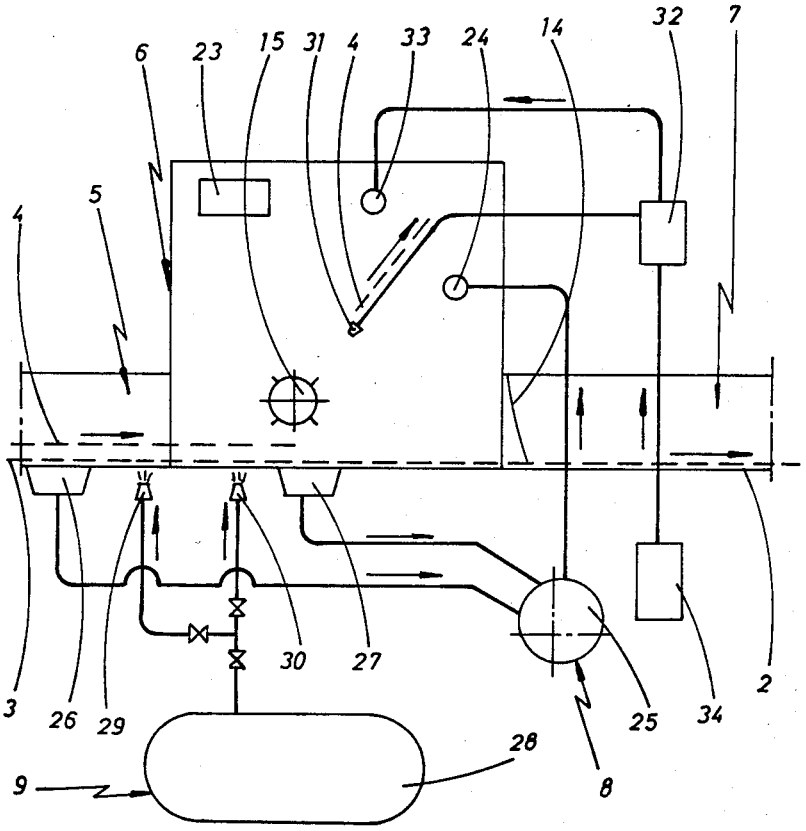
FIG. 5 is a similar view to that shown in FIG. 3 that the extraction equipment consists of both a rotating cylinder and a pneumatic suction device.

In the embodiment shown in FIG. 4, the belt (20) and hair or wool collection roller (19) are replaced by a system comprised of a suction nozzle (31) connected to a cyclone separator (32) which forces air through a nozzle (33) and blows the wool or hair to a container (34) disposed therebetween. In the embodiment shown in FIG. 5, the belt (20) and hair or wool collection roller (19) are replaced by a system comprised of a rotating roller (15) and a suction device (31) linked to a cyclone separator (32) which forces air through a nozzle (33) driving the hair or wool to a container (34) disposed therebelow.

Thus the hair or wool extraction process is carried out on the fleshy side of the pelt in the following manner:

The skins (3) are placed on the conveyor belt (2) in the perforated area (5) as shown in FIG. 2 and are secured to the perforated conveyor belt by the action of the suction ventilator (26) and in the extraction area by means of the suction ventilator (27). Between the two suction devices there are two nitrogen spraying devices in which spraying is carried out by nozzles (29) and (30). Provision is made for either a single or multiple rows of nozzles which administer the liquid nitrogen at successively lower temperatures of between minus 20 degrees celsius and minus 220 degrees celsius.

The effect of the nitrogen is to freeze the skins (3) in such way that the pores contract and release the wool or hair (4). Consequently, the hair or wool may be removed by simple traction using, for example, one of the rollers (15, 16 or 17) depending on the type of wool or hair. The extraction process is carried out in conjunction with an expulsion device (19) which causes the wool or hair to drop on the conveyor belt (20) from which it is transferred to the remaining conveyor belt (21) which transports the wool or hair along a pipeline (22) to a tank or final rinsing unit.

At a terminal stage, the skins (3) travel through the recovery area (7) for warming to enable them to regain their original flexibility. The wool or hair does not need to undergo any such process.

Nitrogen is the preferred gas for use in the freezing stage although it may be feasible to use freon, although this is not advisable due to its chlorine content. Argon may also be used although this has the disadvantage of high cost. Carbon-dioxide may also be used although it poses difficulties when temperatures of below minus 50 degrees celsius are required. Liquid air is not considered appropriate for this process due to the difficulty of obtaining a bulk supply.

The speed of travel of the skins (3) along the conveyor belt (2) is preferably in the order of 1 to 20 meters per minute given that freezing of the pelts takes place almost instantaneously and it is also noted that the humidity of the pelts at the start of processing should range from 50 to 500 percent.

The essential elements of this invention may also be put to use in practical forms other than those outlined above. The system may be constructed in almost any form or size using appropriate materials within the scope or spirit of the invention as defined in the appended claims. Modifications are envisioned and may be incorporated without departing from the scope of the invention as hereinafter defined.

What we claim is:

1. A method of removing hair from an animal pelt, said method comprising:
   - placing the pelt on a support having perforations;
   - applying suction to the pelt through the perforations to secure the pelt to the support;
   - freezing the skin of the pelt to a temperature at which hair pores of the skin open; and
   - removing the hair from the skin.

2. A method of removing hair from an animal pelt, said method comprising:
   - applying liquified gas against the fleshy side of the pelt to freeze the pelt to a temperature at which hair pores of the skin open.

3. A method of removing hair from an animal pelt, said method comprising:
   - freezing the pelt to a temperature at which hair pores of the skin open by preliminarily freezing the skin in a first freezing phase to a temperature between 0° and −20° Celsius, and after the skin has reached said temperature between 0° and −20° Celsius, freezing the skin in a secondary freezing phase to a temperature in the range of −20° Celsius and −220° Celsius.

4. A method of removing hair from an animal pelt, said method comprising:
   - placing the pelt while in a flexible state on a perforated conveyor belt;
   - applying suction to the pelt through the perforations to secure the pelt to the conveyor belt;

preliminarily freezing the pelt to a temperature of between 0° and −20° Celsius by subjecting at least the fleshy side of the pelt to at least one application of liquified gas through the perforated belt, subsequently freezing the pelt to a temperature between −20° and −220° Celsius by subjecting at least one side of the skin to another application of liquid gas;

removing the hair from the skin with hair removal means; and warming the skin toward the ambient temperature.

* * * * *